United States Patent [19]

Yamazaki et al.

[11] 4,031,700

[45] June 28, 1977

[54] HEAT INSULATING APPARATUS FOR EXHAUST PIPE OF AN INTERNAL COMBUSTION ENGINE

[75] Inventors: Nobuo Yamazaki, Gunma; Takeshi Ito, Ohta; Tetsuro Katsurada, Ohta; Yasuhiko Habara, Ohta, all of Japan

[73] Assignee: Fuji Jukogyo Kabushiki Kaisha, Tokyo, Japan

[22] Filed: Nov. 24, 1975

[21] Appl. No.: 634,786

[30] Foreign Application Priority Data

Nov. 26, 1974 Japan ..... 49-143649[U]
Nov. 26, 1974 Japan ..... 49-143651[U]

[52] U.S. Cl. ..... 60/322; 60/323; 138/149

[51] Int. Cl.[2] ..... F01N 7/00

[58] Field of Search ..... 60/282, 322, 324, 323; 138/149, DIG. 8

[56] References Cited

UNITED STATES PATENTS

| | | | |
|---|---|---|---|
| 2,423,213 | 7/1947 | Weber | 60/322 |
| 2,913,870 | 11/1959 | Lashley | 60/324 |
| 3,727,410 | 4/1973 | Scheitlin | 60/322 |
| 3,863,445 | 2/1975 | Heath | 60/299 |
| 3,864,909 | 2/1975 | Kern | 60/322 |
| 3,916,623 | 11/1975 | Heide | 60/288 |

*Primary Examiner*—Douglas Hart
*Attorney, Agent, or Firm*—Martin A. Farber

[57] ABSTRACT

Heat insulating apparatus for an exhaust pipe of an internal combustion engine to maintain exhaust gases at high temperature to reduce unburned constituents. The apparatus is so arranged as to permit the thermal expansion of the exhaust pipe. The exhaust pipe is located with a heat insulating material which in turn is coated with a cover. One end of the cover is secured to the exhaust pipe and the other end is slidably engaged with the exhaust pipe.

7 Claims, 5 Drawing Figures

HEAT INSULATING APPARATUS FOR EXHAUST PIPE OF AN INTERNAL COMBUSTION ENGINE

The present invention relates to a heat insulating apparatus for an exhaust pipe of an internal combustion engine to maintain exhaust gases at high temperatures sufficient for effecting oxidizing reaction of unburned hydrocarbonds and carbon monoxide in the exhaust gases for thereby reducing emission of harmful and noxious compounds contained in the exhaust gases.

Tests have revealed that unburned compounds such as hydrocarbons and carbon monoxide contained in engine exhaust gases can be oxidized or re-burned when the exhaust gases flowing through an engine exhaust system are maintained at a temperature above 800° C for a suitable time period. To maintaine the exhaust system at such a high temperature it is necessary to provide a thermal expansion measures for prevention of deformation, buckling, cracking or breaking of the exhaust system.

Therefore, an object of the present invention is to provide an improved heat insulating apparatus for an exhaust pipe of an internal combustion engine which is arranged to permit thermal expansion of the exhaust pipe and to avoid a concentration of the thermal stress. To this end, in accordance with the present invention, the exhaust pipe comprises two or more branched pipes and a common pipe combined with the branched pipes, and comprises straight portions and bending portions which are alternately arranged and continuously connected with each other. The exhaust pipe is coated with a heat insulating layer which in turn is coated with a cover. The heat insulating layer of the straight portion after each bending portion has an eccentric thickness, whereby thermal expansion of the preceding straight portion may be absorbed.

Other objects, features and advantages of the present invention will be more apparent from the following description with reference to the accompanying drawings, in which.

Figure 1:
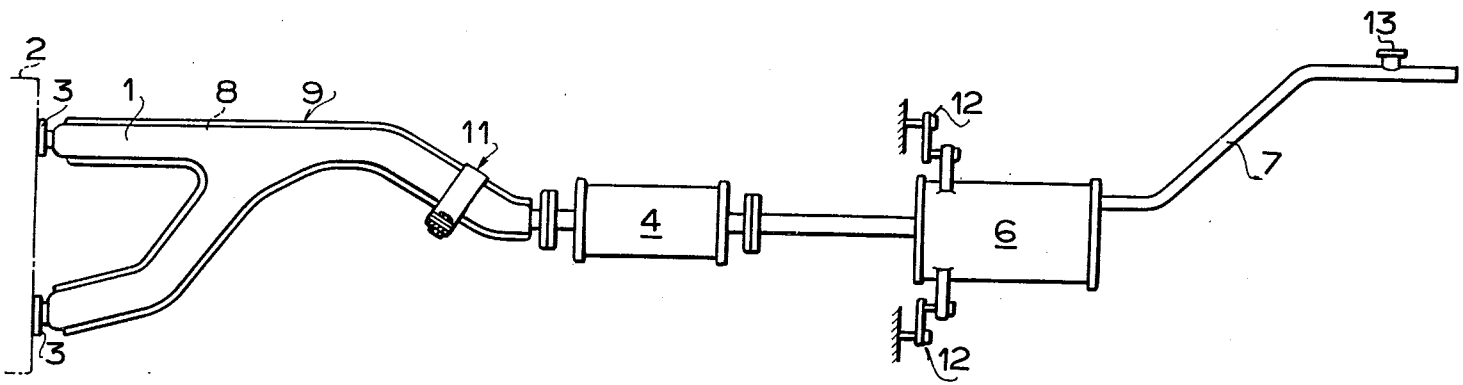
FIG. 1 is a plan view of an exhaust system of an internal combustion engine employing a heat insulating apparatus for an exhaust passage in accordance with the present invention.

Referring to FIG. 1, there is schematically shown a bifurcated exhaust pipe 1 connected to exhaust ports 3 of an internal combustion engine 2. A premuffler 4 is connected to the rear end of the exhaust pipe 1. The rear end of the muffler 4 is connected through a pipe 5 to a maintain muffler 6 to which a tail pipe 7 is also connected.

Figure 2:
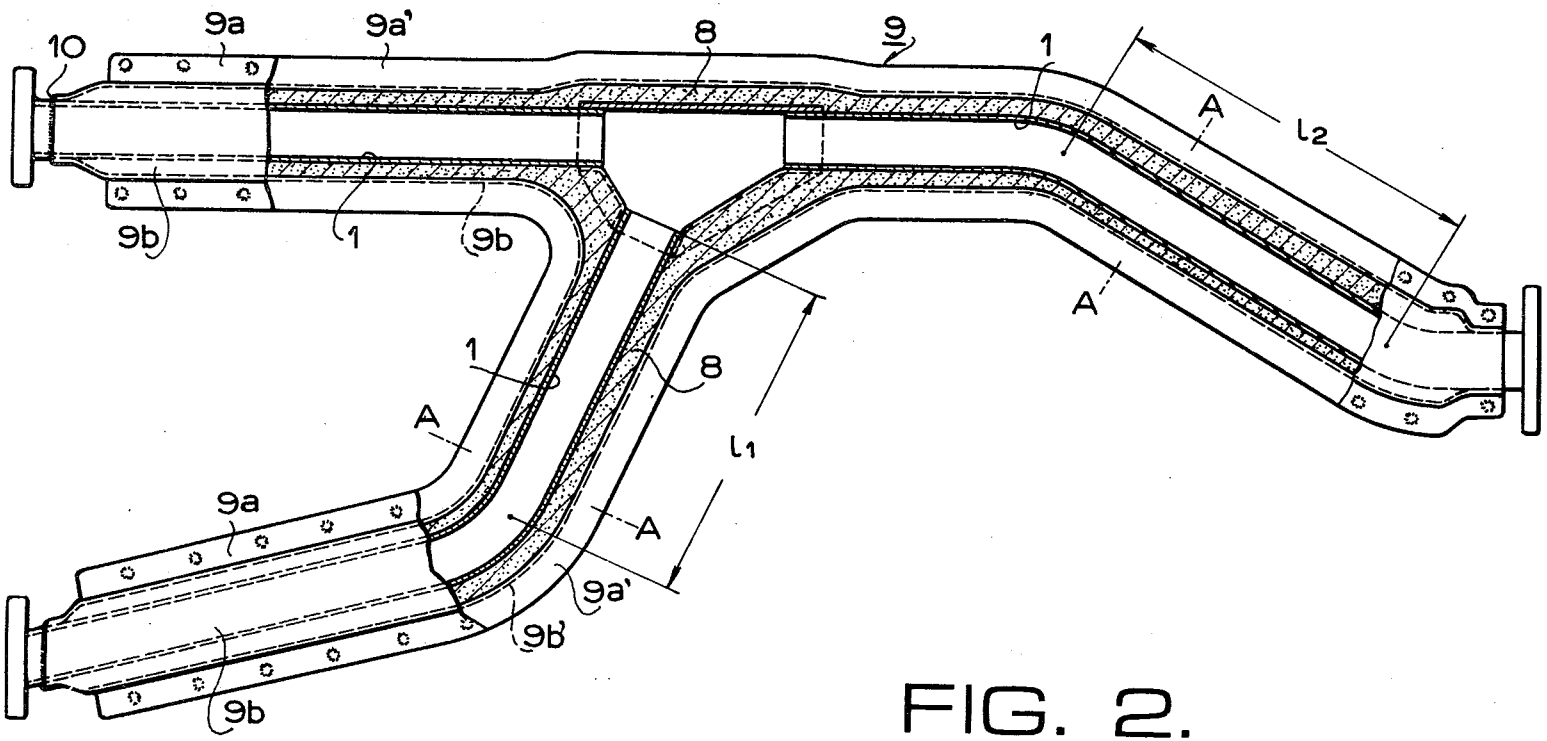
FIG. 2 is an enlarged cross sectional view of an exhaust pipe provided with the heating insulating apparatus according to the present invention.
Figure 3:
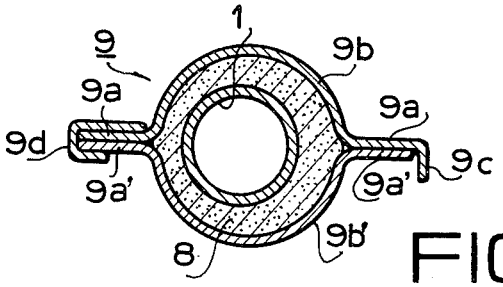
FIG. 3 is a sectional view taken along line A—A of FIG. 2.

As shown in FIGS. 2 and 3, the exhaust pipe 1 comprises straight portions and bending portions, and is covered with a heat insulating layer 8, which in turn is covered by a cover 9. The cover 9 comprises a pair of shells 9*b* and 9*b'* each having a semi-circular cross section. Both shells are connected with each other by some suitable means such as spot welding at flanges 9*a* and 9*a'* to cover the heat insulating layer 8. If the flanges 9*a* and 9*a'* are connected to each other by spot welding, the rainwater will frequently enter the cover 9 through the gap between the flanges 9*a* and 9*a'*. This water is heated in the cover 9 during running condition of the motor vehicle and steam is generated therein. This steam will then eject through the gap between the flanges 9*a* and 9*a'* into the atmosphere in a horizontal direction. In order to prevent danger due to this steam, the upper flange 9*a* is bent downward as indicated at 9*c* in FIG. 3 thereby directing the steam toward the ground. Alternatively, a U-shaped cover 9*d* may be additionally provided on the flanges 9*a* and 9*a'* of the cover 9 so that the rainwater is prevented from entering the cover 9 and the steam generated in the cover is oriented to the exhaust pipe and prevented from ejecting out of the contour of the motor vehicle. Ends of bifurcated portions of the cover 9 are welded at point 10 to bifurcated ends of the exhaust pipe 1, respectively. The rear end of the cover 9 is shrunk and slidably engages with the exhaust pipe 1 as will be hereinafter described.

Figure 4:
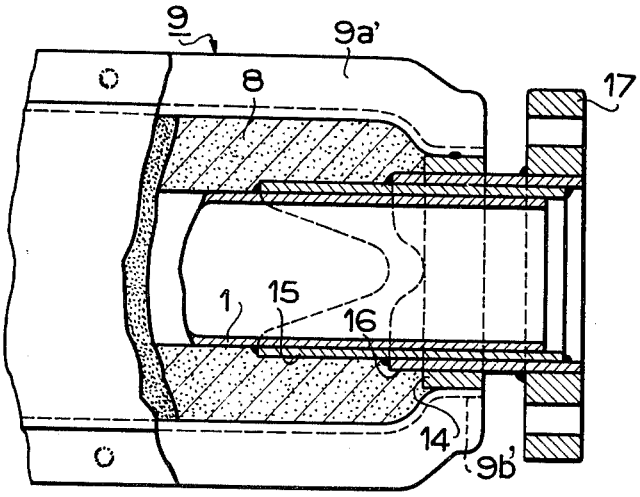
FIG. 4 is an enlarged sectional view showing a main part of the heat insulating apparatus.

As shown in FIG. 4, a first stiffening pipe 15 is disposed on the rear end portion of the exhaust pipe 1 and fixed thereto by some suitable means such as welding. The welded end of the first stiffening pipe 15 has a curved shape, for example a fish mouth shape as shown by dotted line, of which shape provides a thermal stress relaxation effect. A second stiffening pipe 16 is disposed on the first stiffening pipe 15, and welded thereto at the portion spaced at a predetermined distance from the end of the fish mouth shape of the pipe 15. A spacer 14 is secured to the end opening of the cover 9 and slidably engages with the second stiffening pipe 16. The end of each pipe extends outwardly from the end of the cover 9, and a flange 17 is welded to the projected end of the pipe 16 for connection of the premuffler 4.

Figure 5:
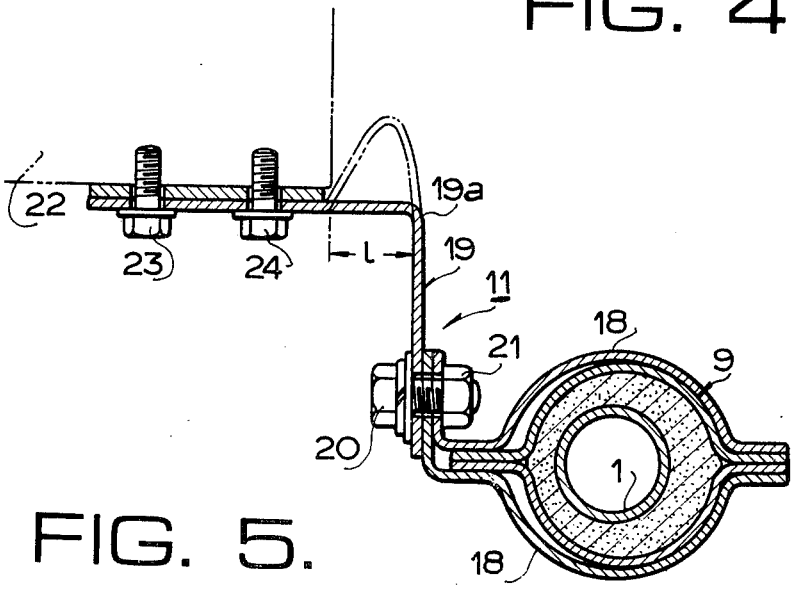
FIG. 5 is a sectional view showing a suspending device of the exhaust pipe.

Suspension devices 11, 12 and 13 respectively are provided. The suspension device 11 is arranged to provide a shock absorbing effect. As shown in FIG. 5, a pair of embracing members 18 are welded to the cover 9. The ends of the embracing members 18 are bent upwardly and engage with each other.

An L-shaped resilient bracket 19 is secured at its one end to the ends of the members 18 by a bolt 20 and a nut 21. The base end of the bracket 19 is secured to a car body 22 by bolts 23 and 24 such that the bent portion 19*a* of the bracket 19 is spaced from the car body by a distance "*l*". Thus, when the exhaust pipe is subjected to excessive external forces, the bracket 19 is elastically deformed as shown by phantom line, in FIG. 5, and consequently the exhaust pipe is prevented from being broken or deformed by the external forces.

As shown in FIG. 2, thermal expansion in the axial direction of each preceding first straight portion (the left-side sections in FIG. 2) is absorbed by deformation or movement in the lateral direction of the second second straight portions L1 or L2 which follow after each bending portion. In order to absorb the lateral deformation or movement of each of the straight portions L1 or L2 after each bending portion, the heat insulating layer 8 of the portion has an eccentric thickness in cross-section, which thickness of the stretching side of the heat insulating layer is greater than that of the radially opposite side as shown in FIG. 3 the cover 9 thereat being eccentrically offset relative to the longitudinal axis of the exhaust pipe 1. If the heat insulating layer 8 does not have a sufficient elasticity to absorb the expansion, a suitable space is preferably provided between the outer wall of the pipe and the heat insulating layer or between the cover 9 and the layer 8.

Thus, in accordance with the present invention, the exhaust pipe is coated with the heat insulating layer 8 which in turn is coated with the cover 9. One end of the cover is secured by welding to the exhaust pipe and the other end of the cover slidably engages with the exhaust pipe. The heat insulating layer has a thickness sufficient for absorbing the thermal expansion of the exhaust pipe. Therefore, even when the engine exhaust gases having a termperature of above 800° C pass through the exhaust pipe, deformation, buckling, cracking or breaking of the pipe may be prevented. Further, the thermal stress applied to the end of the exhaust pipe is dissipated to the superimposed stiffening pipes 15 and 16. Accordingly, the durability of the pipe may be increased.

What is claimed is:

1. An exhaust pipe system for internal combustion engines comprising an exhaust pipe comprising first straight portions and bending portions and second straight portions positioned after the bending portions which are alternately arranged and continuously connected with each other, a heat insulating layer disposed on said exhaust pipe, a cover covering said heat insulating layer, said heat insulating layer on the second straight portions positioned after each said bending portion having an eccentric cross-sectional thickness having a stretching side and a diametrically opposite side, in which the thickness of the stretching side thereof is greater than that of the diametrically opposite side and being adapted to absorb a thermal expansion of a preceding said first straight portions, said cover on said second straight portions after each said bending portion being eccentrically offset relative a longitudinal axis of said second straight portions, and one end of said cover being secured to said exhaust pipe and the other end of said cover slidably engaging with said exhaust pipe.

2. The exhaust pipe system for internal combustion engines as set forth in claim 1, wherein said stretching side is that side of said second straight portions which corresponds to a largest radius of curvature in the plane of said portions of a corresponding one of said bending portions.

3. The exhaust pipe system for internal combustion engines as set forth in claim 1, wherein said exhaust pipe comprises at least two branched portions and a common pipe communicating with said branched portions, and at least one of the latter and said common pipe including said straight and bending portions.

4. The exhaust pipe system as set forth in claim 1, wherein said cover comprises a pair of half shells which are welded to each other and include means constituting bent portions for redirecting an ejecting direction of steam generated in the cover to the vertical direction in which water has entered into the cover passing through a gap between said half shells.

5. A heat insulating apparatus for an exhaust pipe of internal combustion engines, the exhaust pipe having a rear end portion, comprising a heat insulating layer provided on the exhaust pipe, a cover covering said heat insulating layer, a first stiffening pipe means including a forward end for being secured to said rear end portion of the exhaust pipe, and a second stiffening pipe secured to said first stiffening pipe means at a securing portion thereof spaced a predetermined distance from said forward end of said first stiffening pipe means, a rearward end of said cover operatively slidably engaging relative with said second stiffening pipe, and said rear end portion of said exhaust pipe, said first stiffening pipe means and said second stiffening pipe being disposed in superimposed relation to effect an increase of strength of said rear end portion of said exhaust pipe.

6. The heat insulating apparatus for an exhaust pipe of internal combustion engines, as set forth in claim 5 wherein said first stiffening pipe means is secured to the exhaust pipe at said forward end of said first stiffening pipe means, said forward end has a fish-mouth shape, said securing portion of said second stiffening pipe has a fish mouth shape.

7. The exhaust pipe system as set forth in claim 4, wherein said pair of half shells include planar abutting flanges, respectively, said flanges being spot welded to each other defining said gap therebetween, and one of said flanges is vertically bent at an extremity thereof constituting said bent portions for redirecting the ejecting direction of the steam to the vertical direction.

* * * * *